US010925446B2

(12) United States Patent
Edwards et al.

(10) Patent No.: US 10,925,446 B2
(45) Date of Patent: Feb. 23, 2021

(54) ADJUSTABLE BATHROOM GRAB BAR ASSEMBLY

(71) Applicant: LIBERTY HARDWARE MFG. CORP., Winston-Salem, NC (US)

(72) Inventors: Neil Edwards, Kernersville, NC (US); Eddie Riddle, Greensboro, NC (US); Matthew Klein, Whitsett, NC (US); Ty Hagler, Chapel Hill, NC (US); Seth Teeples, Woodinville, WA (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 33 days.

(21) Appl. No.: 16/402,382

(22) Filed: May 3, 2019

(65) Prior Publication Data

US 2020/0345187 A1 Nov. 5, 2020

(51) Int. Cl.
*B25G 1/00* (2006.01)
*A47K 17/02* (2006.01)

(52) U.S. Cl.
CPC ..... *A47K 17/024* (2013.01)

(58) Field of Classification Search
CPC ..... Y10T 16/498; Y10T 16/50; Y10T 16/513; Y10T 16/515; B60N 3/026; B60N 3/02;
(Continued)

(56) References Cited

U.S. PATENT DOCUMENTS 3,082,473 A 3/1963 West
4,932,090 A * 6/1990 Johansson ..... A47K 17/024 5/662

(Continued)

FOREIGN PATENT DOCUMENTS

DE 202014001814 U1 7/2014
DE 202016105133 U1 11/2016

(Continued)

OTHER PUBLICATIONS

U.S. Appl. No. 16/117,620, entitled "Adjustable Bathroom Grab Bar Assembly", filed Aug. 30, 2018, 26 pages.

(Continued)

*Primary Examiner* — Chuck Y Mah
(74) *Attorney, Agent, or Firm* — Brooks Kushman P.C.; Lora Graentzdoerffer

(57) ABSTRACT

A handle assembly and a method of installing the handle assembly are provided. The handle assembly has first and second mounts, and a handle with a handle portion extending between and connecting first and second end regions. The first and second end regions are received for translation along the longitudinal axis within the first and second mounts. First and second locking elements are connected to the first mount, and the handle, respectively. The handle has a first longitudinal position with the first and second locking elements engaged to retain the handle in one of a plurality of angular positions. The handle has a second longitudinal position with the first and second locking elements spaced apart from one another such that the handle and the second locking element are rotatable to change an angular position of the handle relative to the first and second mounts.

20 Claims, 6 Drawing Sheets

(58) Field of Classification Search
CPC .... B60N 3/023; B60N 2/24; B60N 2002/247; B60R 13/02; A60G 7/053; A47K 17/02; A47K 17/022; A47K 17/024; A61G 7/1044; A47B 96/1425; A63B 21/1681; A63B 2244/225
See application file for complete search history.

(56) References Cited

U.S. PATENT DOCUMENTS 4,944,478 A * 7/1990 Sullivan ..... A47K 3/003 211/105.1
4,976,455 A * 12/1990 Brammer, Sr. ..... B60P 3/36 16/319
5,191,837 A * 3/1993 Bolton ..... B41K 1/56 101/333
5,301,570 A * 4/1994 Li ..... B62K 21/125 280/278
5,586,352 A * 12/1996 O'Brien ..... A61G 7/053 248/200.1
6,098,492 A * 8/2000 Juchniewicz ..... B62B 5/064 280/47.371
6,131,213 A 10/2000 Sarff
6,266,850 B1 * 7/2001 Williams ..... B25F 5/026 144/136.95
6,581,245 B2 6/2003 Jen
6,843,468 B2 * 1/2005 Marshall ..... A47K 3/003 248/205.1
6,974,134 B1 * 12/2005 Macri ..... B60N 3/023 16/412
7,195,232 B2 * 3/2007 Marshall ..... A47K 3/003 16/438
7,249,395 B2 * 7/2007 Brammer, Jr. ..... E05B 1/0015 16/412
D584,129 S 1/2009 Miller
D623,928 S 9/2010 Weber
7,823,229 B2 11/2010 O'Brien et al.
7,849,564 B2 12/2010 Miller
8,171,587 B1 5/2012 Haessly
8,474,921 B2 7/2013 Newkirk et al.
9,968,226 B1 5/2018 Anderson
10,457,182 B2 * 10/2019 McKinnon ..... B62K 21/125 280/278
2007/0204437 A1 * 9/2007 Hartmann ..... B60Q 1/2669 16/444
2008/0289296 A1 11/2008 Weber
2011/0203078 A1 8/2011 Farrow, Sr.
2016/0143494 A1 5/2016 Thomas
2016/0368408 A1 12/2016 Magoolaghan
2020/0069122 A1 * 3/2020 Edwards ..... B62B 5/064 280/47.371

FOREIGN PATENT DOCUMENTS

EP 3158907 A1 4/2017
JP S6195157 A 5/1986
JP S6195159 A 5/1986
JP 3723118 B2 12/2005
JP 4100258 B2 6/2008
JP 4399858 B2 1/2010
JP 5257836 B2 8/2013
JP 5979605 B2 8/2016

OTHER PUBLICATIONS

U.S. Office Action for U.S. Appl. No. 16/117,620, dated Mar. 19, 2020, 7 pages.
U.S. Office Action for U.S. Appl. No. 16/117,620, dated Jul. 24, 2020, 7 pages.

* cited by examiner

ADJUSTABLE BATHROOM GRAB BAR ASSEMBLY

TECHNICAL FIELD

Various embodiments relate to grab bar assemblies for use in a bathroom.

BACKGROUND

A handle assembly is illustrated and described in U.S. Pat. No. 7,849,564 B2, which issued on Dec. 14, 2010 to F. Troy Miller.

SUMMARY

In an embodiment, a handle assembly is provided with first and second mounts, each mount to connect to a wall. A handle has first and second end regions spaced apart along a longitudinal axis, and a handle portion extending between and connecting the first and second end regions. The first and second end regions are received for translation along the longitudinal axis within the first and second mounts, respectively. A first locking element is positioned within and fixed relative to the first mount. A second locking element is connected to and fixed relative to the first end region of the handle. The handle has a first longitudinal position relative to the first and second mounts with the first and second locking elements engaged with one another to position and retain the handle in one of a plurality of angular positions relative to the first and second mounts and for grasping by a user. The handle has a second longitudinal position relative to the first and second mounts with the first and second locking elements spaced apart from one another such that the handle and the second locking element are rotatable relative to the first and second mounts and the first locking element to change an angular position of the handle relative to the first and second mounts.

In another embodiment, a handle assembly is provided with first and second mounts, each mount to connect to a wall. A first handle extends along a longitudinal axis between first and second end regions, with the first and second end regions received for translation along the longitudinal axis within the first and second mounts, respectively. A second handle has third and fourth end regions, with each end region connected and fixed relative to the first handle. The third and fourth end regions are spaced apart from one another such that an outer surface of the first handle therebetween is accessible for grasping by a user. A first locking element is received by and connected to the first mount. A second locking element is connected to a first end region of the first handle. The second locking element engages with the first locking element to retain the first handle in one of a plurality of pivotal positions relative to the first and second mounts. The first and second locking elements cooperate to constrain rotation of the first handle relative to the first and second mounts. Translation of the first handle disengages the first and second locking elements. The first handle is rotatable relative to the first and second mounts when the first and second locking elements are disengaged.

In yet another embodiment, a method of installing a grab bar assembly is provided. A first mount is mounted to a wall surface. A second mount is mounted to the wall surface, the first and second mounts aligned along a vertical axis. First and second end regions of a grab bar are positioned within the first and second mounts, respectively, such that the grab bar is received for translation relative to the first and second mounts along a longitudinal axis parallel with the vertical axis. The grab bar having a first surface for grasping by a user spaced apart from the wall surface and extending along the longitudinal axis, and a second surface for grasping by a user spaced apart from the first surface and extending along an axis parallel with the longitudinal axis. A first locking element connected to the first mount is engaged with a second locking element connected to a first end region of the grab bar. A position of the grab bar is adjusted relative to the first and second mounts by translating the grab bar along the longitudinal axis and towards the second mount thereby disengaging the second locking element from the first locking element, pivoting the grab bar about the longitudinal axis, and translating the grab bar along the longitudinal axis and towards the first mount thereby engaging the second locking element with the first locking element.

DETAILED DESCRIPTION

Figure 1:
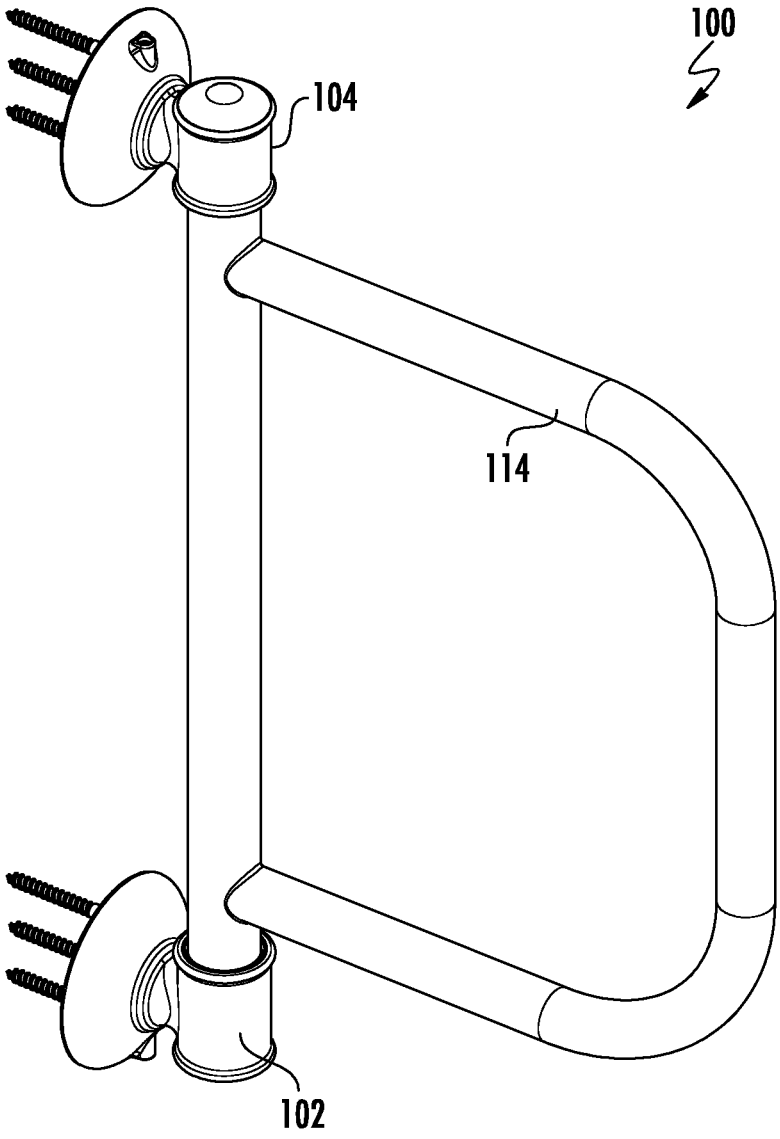
FIG. 1 is a perspective view of a grab bar assembly in a first position according to an embodiment.
Figure 2:
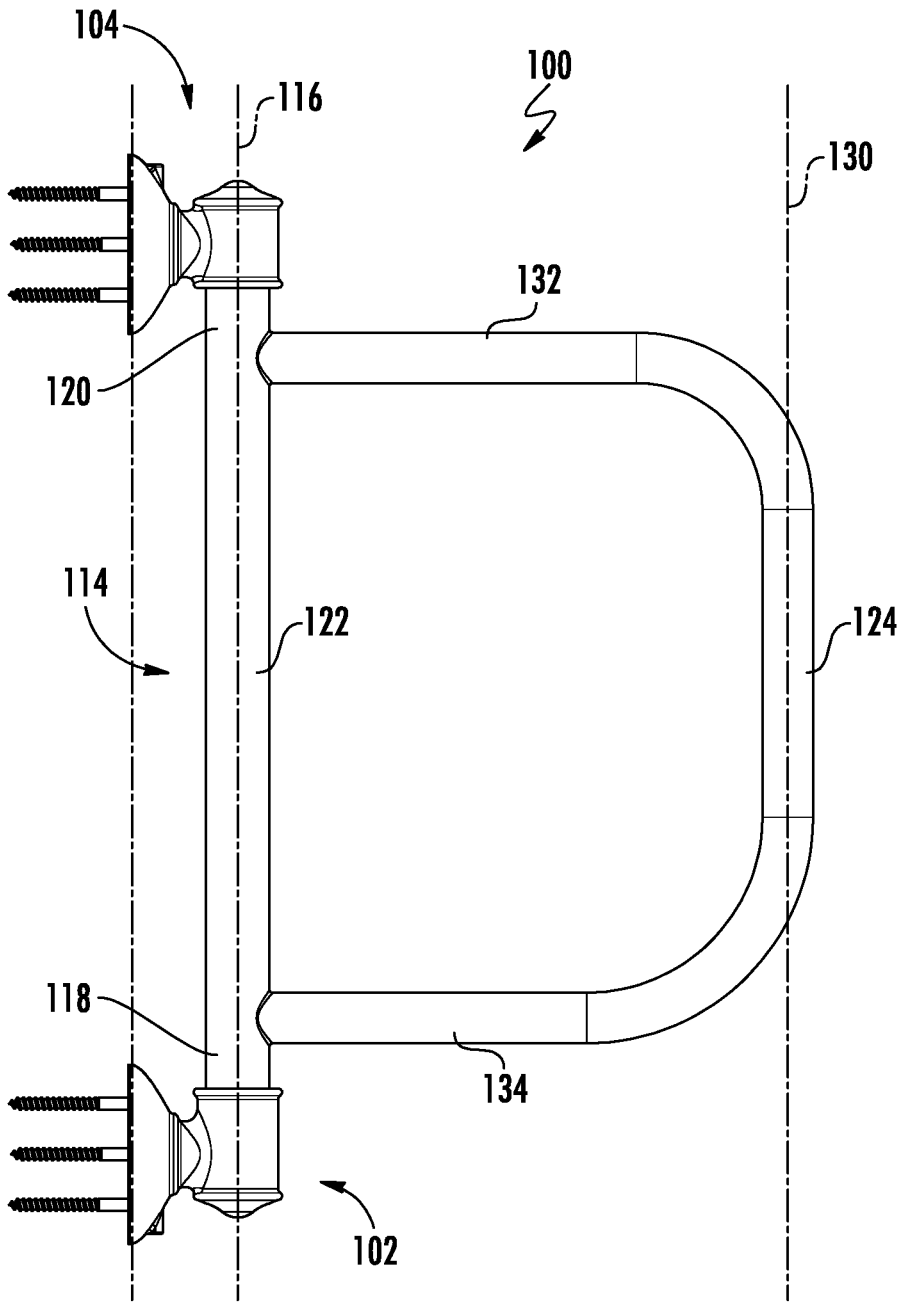
FIG. 2 is a front plan view of the grab bar assembly of FIG. 1 in the first position.
Figure 3:
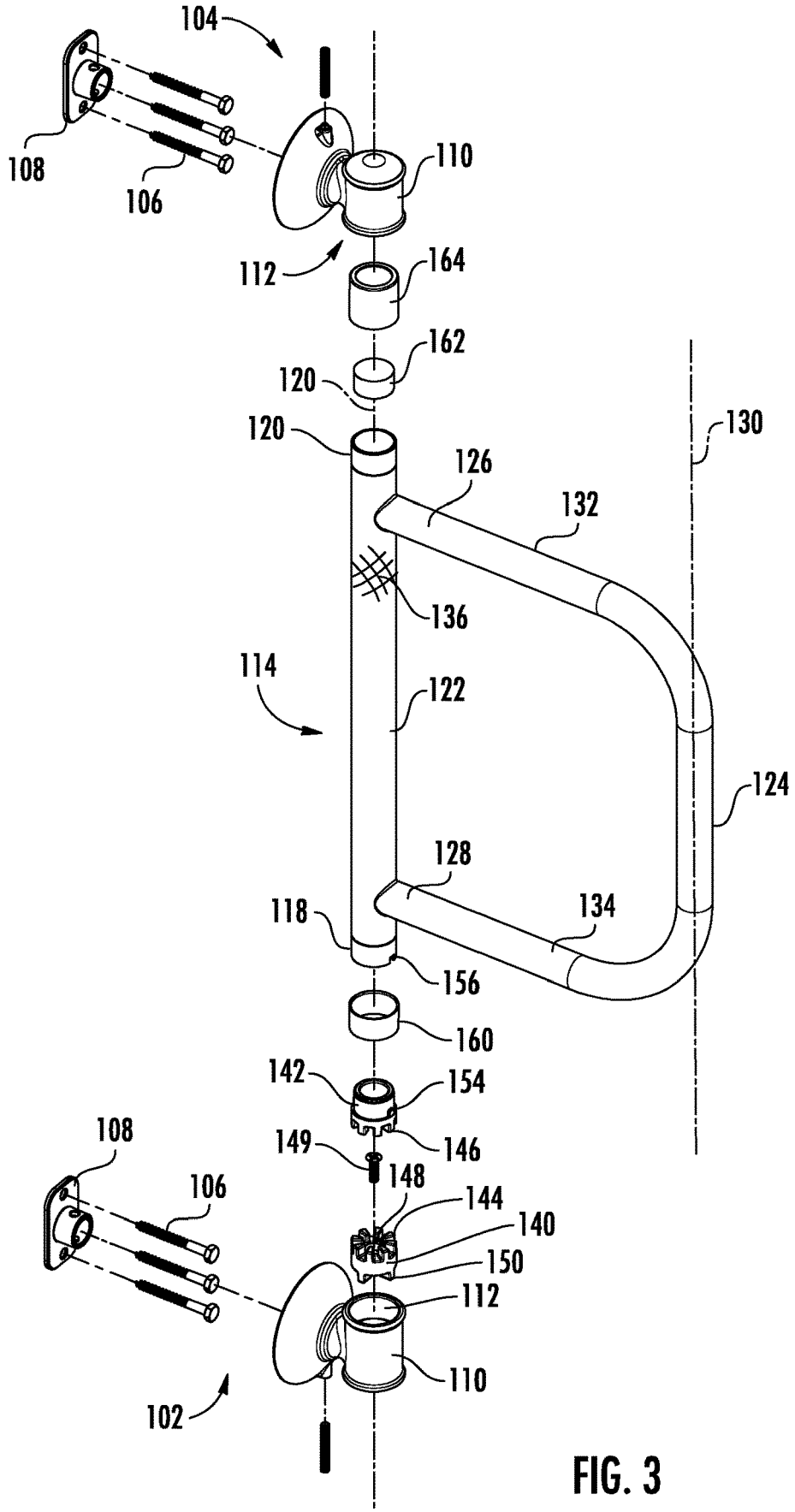
FIG. 3 is an exploded perspective view of the grab bar assembly of FIG. 1.

As required, detailed embodiments of the present disclosure are provided herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Handle assemblies or grab bar assemblies may be provided in a bathroom environment to provide a grasping surface for a user. For example, people with mobility issues may use a grab bar to aid in movements such as sitting or standing, maintaining balance, and the like. Depending on the bathroom configuration or layout, it may be desirable to place and lock the grab bar into various positions, or to change the position of the grab bar for use by the user or for use by different users. Furthermore, it may be desirable to have a storage position to move the grab bar out of the way.

For example, the grab bar assembly may be provided to mount outside of, adjacent to, or within a shower or bath enclosure to guide and aid users as they transition into or out of the enclosure, with the grab bar assembly folding for storage when not in use. The grab bar assembly may aid users with mobility or balance issues or users with poor vision. The grab bar assembly also provides an additional grasping surface when used next to or within a bathing enclosure where water may increase the slipperiness of a floor surface, or where a sill, step, or other structure must be navigated by a user.

FIGS. 1-5 illustrate a grab bar assembly 100 or handle assembly 100 according to an embodiment. The assembly 100 has first and second mounts 102, 104, with each mount having associated hardware to fasten or connect the mount 102, 104 to a surface, such as a vertical wall surface in or adjacent to a bathing enclosure.

Each of the mounts 102, 104 may be provided as a mounting assembly with mounting hardware 106 or fasteners connecting a base structural element 108 such as a mounting plate to a wall surface. A backing plate may additionally be provided. A cover element 110 may be connected to the mounting plate to conceal the fasteners. The cover element 110 defines a recessed area 112 or region. The recessed area 112 may be defined by a cylindrical inner side wall. In other examples, each of the mounts 102, 104 may be provided as an integral structure.

A handle 114 or grab bar 114 is provided and extends along a longitudinal axis 116 as shown. The first grab bar 114 has first and second end regions 118, 120 that are supported by the first and second mounts 102, 104, respectively. The grab bar 114 and longitudinal axis 116 may be oriented vertically or substantially vertically, e.g. within five to ten degrees of vertical. The grab bar 114 may include a handle portion 122 that extends linearly along the axis 116 and between the first and second end regions 118, 120 as shown. The mounts 102, 104 may be dimensioned to position the handle portion 122 at a specified distance from the wall surface, e.g., a stand-off distance. In one example, the handle portion 122 is positioned with 1.5 inches away of space or more between the handle portion 122 and the wall surface.

Additionally or alternatively, the handle or grab bar 114 may include another handle portion 124. The handle portion 124 extends between and connects the first and second end regions 118, 120. The second handle portion 124 has third and fourth end regions 126, 128 each connected and fixed relative to the first handle portion 122, with the third and fourth end regions 126, 128 spaced apart from one another such that an outer surface of the first handle 122 therebetween is accessible for grasping by a user. The another handle portion 124 may define a region for grasping extending along another longitudinal axis 130, with the another longitudinal axis 130 being parallel to and spaced apart from the longitudinal axis 116. The another handle portion 124 may additionally include transversely oriented regions 132, 134 that provide additional regions for grasping by a user. The sections or regions 122, 124, 132, 134 are shown to extend linearly. The transverse regions 132, 134 may extend substantially perpendicular to the region 122 and longitudinal axis 116, or substantially horizontal, e.g. within five to ten degrees of horizontal.

In one example, the regions 122, 124 of the handle 114 provides at least five continuous linear inches of a grasping surface. In other examples, one or more of the regions 122, 124, 132, 134 has a linear grasping surface lying within a range of five to twelve inches, and may have a longer grasping surface in other examples. In other examples, the each of the regions 122, 124, 132, 134 may have a linear grasping surface lying within ranges of five to eighteen inches, five to twelve inches, twelve to eighteen inches, and may have other length grasping surfaces in other examples.

In other examples, the handle 114 may have other shapes or regions for grasping oriented thereon. Although the handle 114 is shown as having a U-shaped section formed by regions 124, 132, 134 attached to a linear region 122, other shapes are also contemplated. For example, one or more of the regions may be formed with a curved shape or curved section. In another example, the U-shaped structure may be replaced with a triangular shape, e.g. with section 132 and another linear section extending between section 132 and the end region 118.

The grasping, outer surfaces of the handle 114 may be provided with a textured surface 136 and/or a coating 136 to provide additional grip for a user. For example, a textured surface may be provided by a knurled pattern, or another pattern or texture. A coating may be provided by a rubberized coating or the like. The coating may provide a softer surface, and may be solid, semi-transparent, or transparent. Only a small representative region of the handle 114 is shown with a pattern or coating 136, and further coverage of the handle 114 with a pattern or coating is also contemplated.

Figure 4:
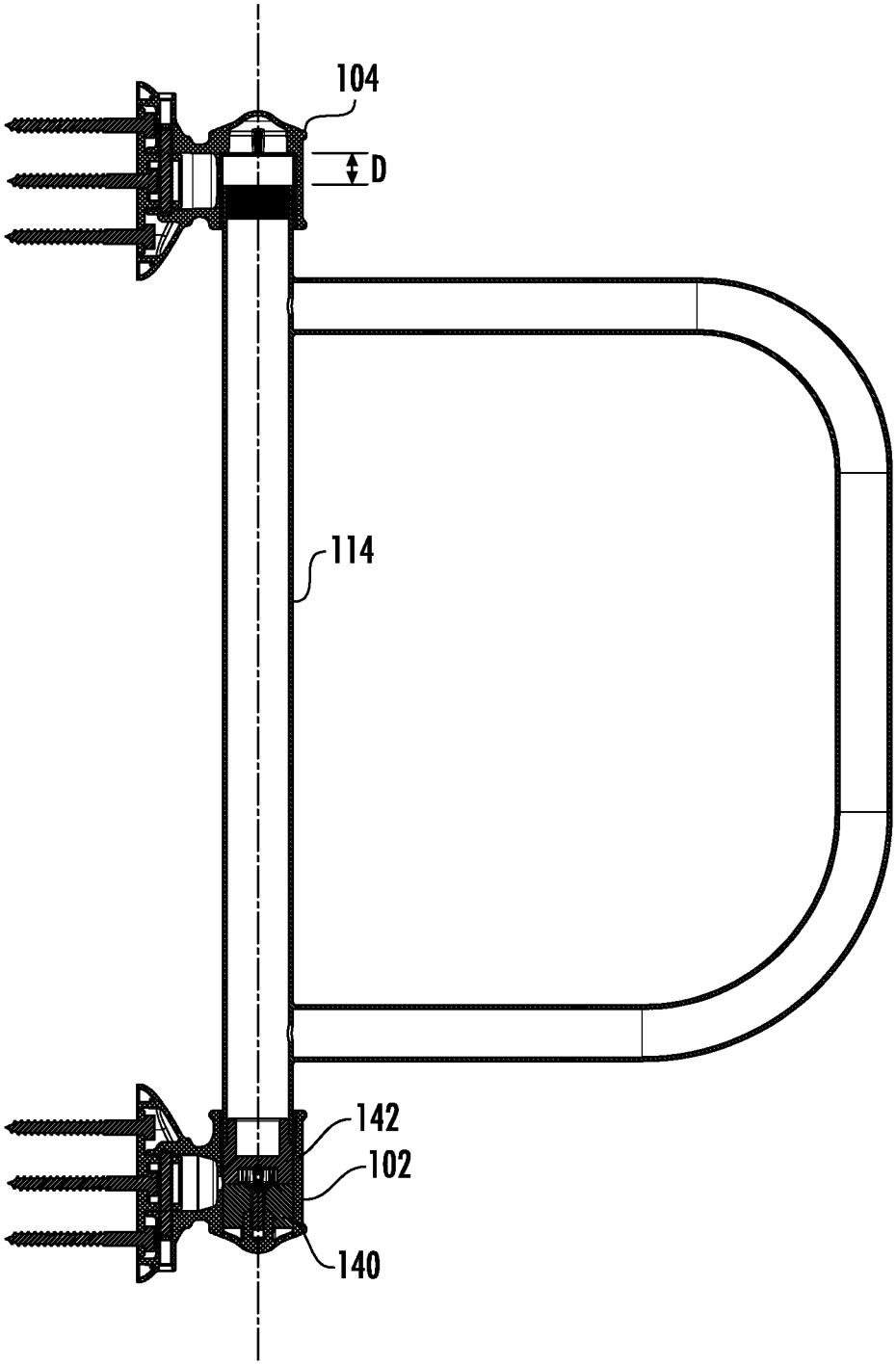
FIG. 4 is a sectional view of the grab bar assembly of FIG. 1 with the handle in the first longitudinal position.
Figure 5:
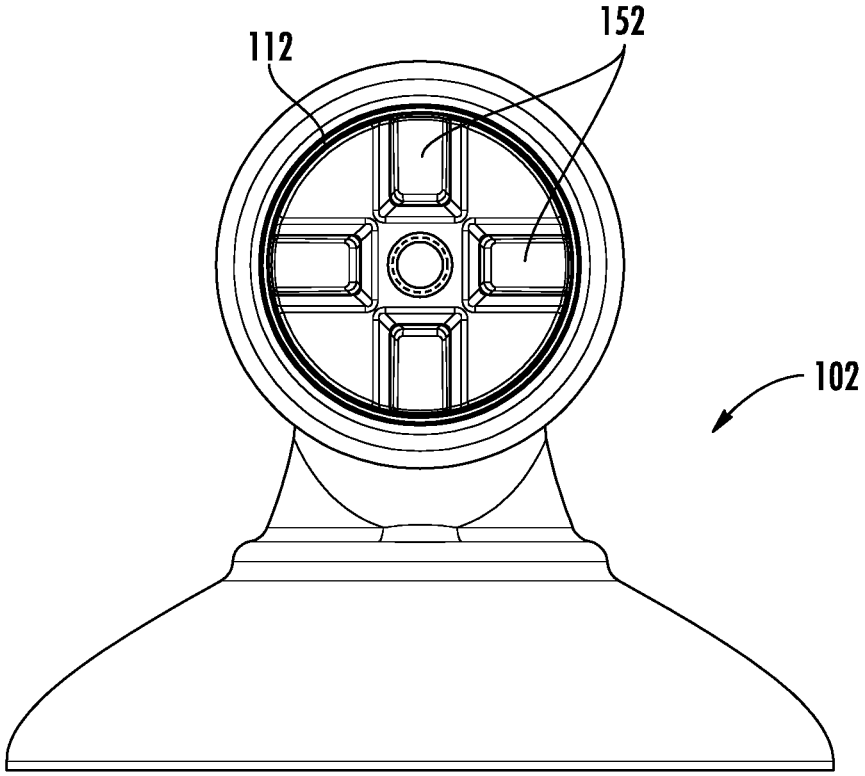
FIG. 5 is a top plan view of the first mount of the grab bar assembly of FIG. 1.

The handle 114 is configured to move or translate longitudinally along the axis 116 between at least a first longitudinal position and a second longitudinal position. FIG. 4 illustrates a sectional view of the handle 114 in the first longitudinal position. The first mount 102 and the second mount 104 each form a recessed region 112 sized to receive a respective end region 118, 120 of the handle therein for translation along the longitudinal axis 116. The first and second mounts 102, 104 are spaced apart from one another such that the end regions 118, 120 of the handle remain within the recessed region 112 of their respective mount in the first longitudinal position and the second longitudinal position. In other words, the recessed regions 112 of the mounts 102, 104 retain the handle 114 and prevent a transverse translational movement of the handle 114, e.g. in the horizontal axis, or axis transverse to the axis 116.

A first locking element 140 is positioned within the recessed region 112 of the first mount 102. The first locking element 140 is connected to the first mount 102 and fixed relative to the first mount. The first locking element 140 therefore cannot move or rotate relative to the first mount 102.

A second locking element 142 is connected to and fixed relative to the first end region 118 of the handle 114. The second locking element 142 cannot move or rotate relative to the handle 114. The second locking element 142 engages, mates, or cooperates with the first locking element 140 to retain the handle 114 in one of a plurality of pivotal or angular positions relative to the first and second mounts 102, 104. The first and second locking elements 142, 144 cooperate to constrain rotation of the handle 114 relative to the first and second mounts 102, 104 with the handle 114 in the first longitudinal position.

FIG. 4 illustrates the handle 114 in the first longitudinal position, and in a first angular position. Translation of the handle away from the first mount disengages the first and second locking elements 140, 142 such that the handle is in the second longitudinal position. When in the second longitudinal position, the handle 114 may be rotated relative to the first and second mounts 102, 104 to another selected angular position. The handle 114 may then be translated towards the first mount 102 to reengage the first and second locking elements 140, 142 to constrain the handle 114 in the another selected angular position.

In other words, when the handle 114 is in a first longitudinal position relative to the first and second mounts 102, 104, the first and second locking elements 140, 142 are engaged with one another to position and retain the handle in one of a plurality of angular positions relative to the first and second mounts 102, 104 and for grasping by a user. The handle 114 is configured to translate a distance D towards the second mount 104 to move from the first longitudinal position to the second longitudinal position to disengage the first and second locking elements 140, 142 and rotate the handle to another one of the plurality of angular positions. When the handle 114 is in a second longitudinal position relative to the first and second mounts 102, 104, the first and second locking elements 140, 142 are spaced apart from one another along the longitudinal axis 116 such that the handle 114 and the second locking element 142 are rotatable relative to the first and second mounts 102, 104 and the first locking element 140. In the second position, the handle 114 freely rotates or pivots about the longitudinal axis 116 as the locking elements 140, 142 are disengaged and spaced apart from one another.

According to an example, the first locking element 140 has an upper face defining a series of first teeth 144 spaced apart from one another. The teeth in the first series of teeth 144 may extend radially on the first locking element. The second locking element 142 has a lower face defining a series of second teeth 146 spaced apart from one another. The teeth in the second series of teeth 146 may extend radially on the second locking element. Each tooth of the second series of teeth 146 is sized to be received between adjacent teeth in the first series 144 to engage the first and second locking elements 140, 142 and retain the handle 114 in an angular position. Each of the first and second series of teeth 144, 146 may have the same number or teeth, or in alternative examples, may have another number of teeth.

According to a further example, the first locking element 140 defines one of a first locking member and a series of second locking members, and the second locking element 142 defines the other of the first locking member and the series of second locking members. The first locking member cooperates and engages with at least one of the series of second locking members to limit rotational movement of the second locking member relative to the first locking member. In one example of the first locking member is provide by a single tooth in the first series of teeth 144, and the second locking member is provided by the second series of teeth 146. The first locking member may be provided by a protruding tooth, a pin, an aperture, a slot, or another similarly structured feature. The second locking member in the series of second locking members may be a protruding tooth, a pin, an aperture, a slot, or another similarly structured feature that is sized to receive or mate with the first locking member. The second locking members in the series of second locking members are spaced apart from one another, for example, with angular spacing. The second locking members may have equiangular spacing about the locking element, or may have variable spacing about the locking element. The series of second locking members may provide for two or more angular positions of the handle. In various examples, the first and second locking elements may provide for two, three, four, five, six, eight, ten, or more angular positions of the handle, although the handle positions may be limited by interference from an adjacent wall structure.

In various examples, the teeth of first and second locking elements 140, 142 may be provided with tapered ends to allow for easier alignment and engagement of the teeth of the first locking element and the second locking element.

The first and second locking elements 140, 142 may cooperate to provide the handle assembly 100 with two angular positions, or more than two angular positions that are uniformly or non-uniformly spaced about first mount 102, or based on the range of motion for the handle of the first mount based on an adjacent mounting surface. In one non-limiting example, a pivotal position for the handle 114 is provided every 45 degrees through a range of motion of up to 270 degrees about axis 116. In another non-limiting example, a pivotal position for the handle 114 is provided every 20-25 degrees through a range of motion of up to 180 degrees about axis 116. In a further non-limiting example, a pivotal position for the handle 114 is provided every 20-25 degrees through a range of motion of up to 360 degrees about axis 116.

The first locking element 140 may be provided with one or more apertures 148 therethrough to connect the first locking element 140 to the first mount 102. In the example shown, the first locking element 140 is provided with a central aperture 148 extending longitudinally therethrough and an associated fastener 149 is used to connect the locking element to the mount. In order to prevent rotation of the first locking element 140 relative to the first mount 102, a key 150 and keyway 152 may additionally be provided. In the example shown, a lower face of the first locking element defines one or more keys 150, and the first mount defines one or more keyways 152 or slots sized to receive the keys. The key 150 is received by the keyway 152 when the first locking element 140 is positioned within the first mount 102 to prevent rotation of the first locking element relative to the first mount. In another example, the lower face of the first locking element may be provided with the keyway, and the first mount may define an associated key. Although the key is shown as a finned structure, other shapes are also contemplated with the keyway complementing the key.

In other examples, the first locking element 140 may be provided with a pair of apertures 148 and a pair of fasteners 149, which would both connect the locking element to the mount and prevent rotational movement of the locking element relative to the mount. Alternatively or additionally, an adhesive or other chemical fastening method may be used to connect the locking element 140 to the mount 102, and the adhesive may be used in conjunction with the key and keyway to further limit rotation of the first locking element relative to the first mount.

The second locking element 142 may be provided with one or more locating tabs 154 therethrough to locate and connect the second locking element 142 to the handle 114. In the example shown, the second locking element 142 is provided with one or more tabs 154 extending outwardly therefrom. The end region 118 of the handle additionally has a slot 156 extending therethrough. The tab 154 fits into the slot 156 to prevent rotation of the second locking element relative to the handle. In the example shown, the second locking element 142 may be press fit into the handle, or may be connected using a chemical fastening technique, such as with an adhesive.

In an alternative embodiment, the second locking element 142 and the end region 118 of the handle may be provided with an aperture therethrough, and a fastener may be used to connect the locking element to the end region 118 by extending through the apertures of the second locking element and the handle to connect the locking element to the handle to prevent rotation of the second locking element relative to the handle.

In various non-limiting examples, a first bushing 160 may be provided for connection of the second locking element 142 to the handle 114, with the first bushing 160 sized to receive the end region 118 of the handle and extend about a perimeter thereof. The first bushing 160 may be press fit onto the end region 118 or may be connected using an adhesive, or the like. The end region 118 of the handle is positioned between the first bushing 160 and the second locking element 142.

Second and third bushings 162, 164 are connected to the end region 120 of the handle 114 and the second mount 104. At least one of the bushings 162, 164 provides an interface between the second end region 120 of the handle and the second mount 104, for example, to reduce friction during movement of the handle when it is being repositioned. In one example, the second bushing 162 is sized to fit within the end region 120, for example, as a stopper or plug insert into the end region 120. In another example, the second bushing 162 extends over the end of the end region and also extends circumferentially about the side of the second end region of the handle, and the third bushing is provided within the aperture of the mount 104 as a liner or sleeve insert. The second and third bushings 162, 164 may provide a stop when the handle is in the second longitudinal position. In one example, each of the second and third bushings 162, 164 are interference fit into their respective positions. In another example, an adhesive material is used to connect the bushings with the handle and mount, respectively.

In various non-limiting examples, first and/or second locking elements 140, 142 may be formed from a material have a low coefficient of friction, such as PTFE, polyimide, PEEK, PPS, Nylon, or Acetal. The first, second, and/or third bushings 160, 162, 164 may also be formed from a material with a low coefficient of friction. The material used for the locking elements 140, 142 and bushings 160, 162, 164 may be selected to ease movement of the handle, reduce noise and rattle, and prevent scratching the surface finish of the handle.

The grab bar assembly 100 as described herein may be formed from a metal, a plastic, or a combination of metal and plastic components. Furthermore, the grab bar assembly 100 may be provided with different surface finishes and/or colors, such as brushed or polished chrome, nickel, white, and the like.

As shown in FIGS. 1-5, the handle assembly 100 is provided without a biasing member to longitudinally bias or move the handle towards one of the first and second positions. The assembly 100 is also without any biasing members interfacing with the locking elements 140, 142. In FIGS. 1-5, the handle assembly is maintained in the first position due to gravity and the weight of the handle, and the locking members are of a sufficient depth to prevent inadvertent movement of the handle to another angular position. The omission of a biasing element makes it easier for a user to lift the handle and change the angular position.

In another embodiment, a biasing member is provided between the bushings 162, 164 at the second end region 120 of the handle and the second mount 104, e.g. inside the recessed area 112. The biasing member may be provided by a spring, such as a coil spring. The biasing member biases the handle 114 longitudinally towards the first mount 102, such that the first and second locking elements 140, 142 are biased towards engagement with one another. In order to move the handle 114 from the first position to the second position, the user is required to lift the handle and overcome the force provided by the biasing member.

Figure 6:
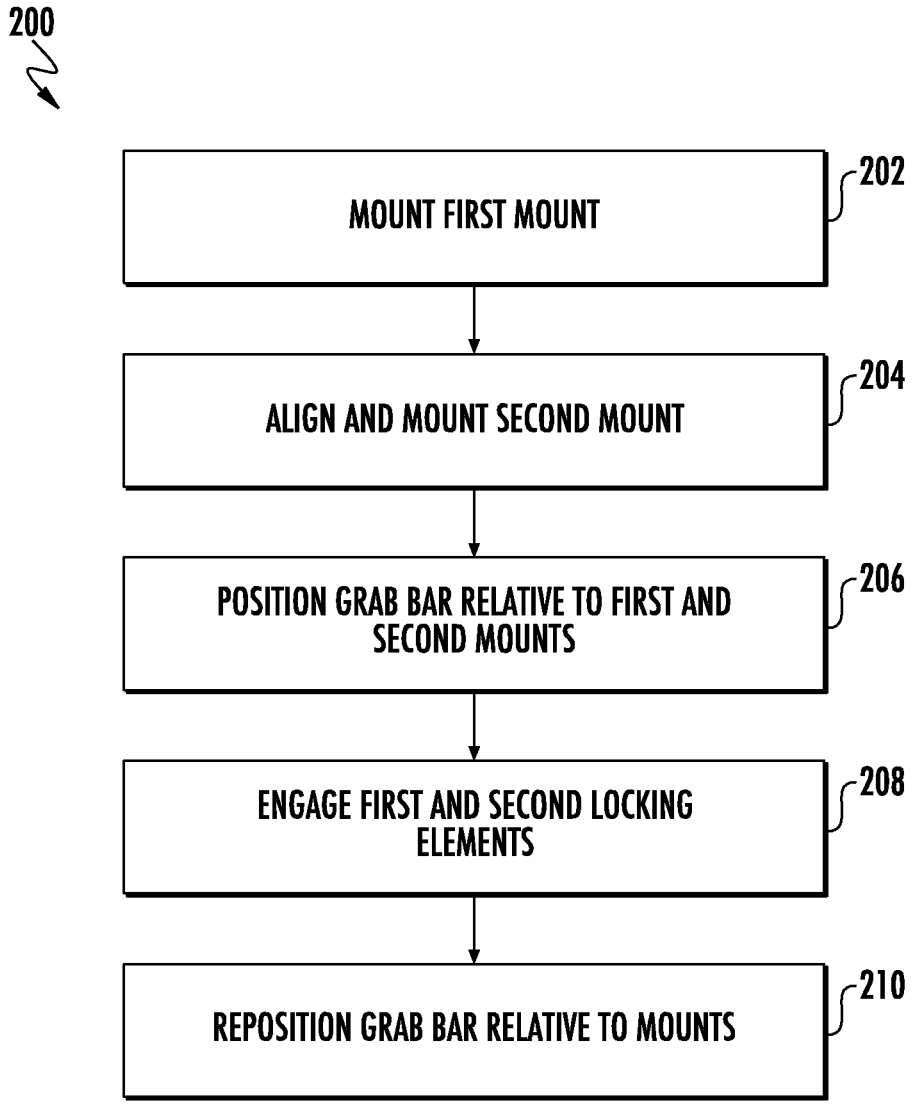
FIG. 6 is flow chart illustrating a method of installing a grab bar assembly.

FIG. 6 illustrates a flow chart for a method 200 of installing a grab bar assembly, such as the grab bar assembly shown in FIG. 1. In various embodiments, the steps of the method may be performed in another order, combined, performed simultaneously or sequentially, or omitted. Additional steps may also be added to the method below.

At step 202 a first mount is mounted to a vertical wall surface.

At step 204, a second mount is mounted to the vertical wall surface. According to an example, the first and second mounts are aligned along a vertical axis;

At step 206, the first and second end regions of a grab bar are positioned within the first and second mounts, respectively, such that the grab bar is received for translation relative to the first and second mounts along a longitudinal axis parallel with the vertical axis. In one example, the grab bar has a first surface for grasping by a user spaced apart from the wall surface and extending along the longitudinal axis, and a second surface for grasping by a user spaced apart from the first surface and extending along an axis parallel with the longitudinal axis.

At step 208, a first locking element connected to the first mount is engaged with a second locking element connected to a first end region of the grab bar.

At step 210, a position of the grab bar is adjusted relative to the first and second mounts by translating the grab bar along the longitudinal axis and towards the second mount thereby disengaging the second locking element from the first locking element, pivoting the grab bar about the longitudinal axis, and translating the grab bar along the longitudinal axis and towards the first mount thereby engaging the second locking element with the first locking element.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A handle assembly comprising:

first and second mounts, each mount to connect to a wall;

a handle with first and second end regions spaced apart along a longitudinal axis and a handle portion extending between and connecting the first and second end regions, the first and second end regions received for translation along the longitudinal axis within the first and second mounts, respectively;

a first locking element positioned within and fixed relative to the first mount; and a second locking element connected to and fixed relative to the first end region of the handle;

wherein the handle has a first longitudinal position relative to the first and second mounts with the first and second locking elements engaged with one another to position and retain the handle in one of a plurality of angular positions relative to the first and second mounts and for grasping by a user;

wherein the handle has a second longitudinal position relative to the first and second mounts with the first and second locking elements spaced apart from one another such that the handle and the second locking element are rotatable relative to the first and second mounts and the first locking element to change an angular position of the handle relative to the first and second mounts;

wherein a lower face of the first locking element defines one of a key and a keyway;

wherein the first mount defines the other of a key and a keyway; and wherein the key is received by the keyway when the first locking element is positioned within the first mount to prevent rotation of the first locking element relative to the first mount.

2. The handle assembly of claim 1 wherein the handle is translatable towards the second mount to move from the first position to the second position to disengage the first and second locking elements and rotate the handle to another one of the plurality of angular positions.

3. The handle assembly of claim 1 wherein the first locking element defines one of a first locking member and a series of second locking members; and wherein the second locking element defines the other of the first locking member and the series of second locking members; and wherein the first locking member cooperates and engages with at least one of the series of second locking members to limit rotational movement of the second locking member relative to the first locking member.

4. The handle assembly of claim 1 wherein the first locking element has an upper face defining a series of first teeth extending radially and spaced apart from one another; and wherein the second locking element has a lower face defining a series of second teeth extending radially and spaced apart from one another.

5. The handle assembly of claim 4 wherein each of the first teeth is sized to be received between adjacent second teeth to engage the first and second locking elements and retain the handle in an angular position.

6. The handle assembly of claim 1 wherein the first locking element defines a central aperture extending longitudinally through the first locking element; and wherein the handle assembly further comprising a fastener extending through the central aperture to connect the first locking element to the first mount.

7. The handle assembly of claim 1 further comprising a bushing connected to the first end region of the handle, the bushing sized to receive the first end region of the handle and extend about a perimeter thereof.

8. The handle assembly of claim 7 wherein the first end region of the handle is positioned between the bushing and the second locking element.

9. The handle assembly of claim 1 further comprising a bushing positioned within the second mount and sized to receive the second end region of the handle and extend about a perimeter thereof.

10. The handle assembly of claim 1 wherein the handle portion defines a region for grasping extending along another longitudinal axis, the another longitudinal axis parallel to and spaced apart from the longitudinal axis.

11. The handle assembly of claim 10 wherein the handle has a second handle portion extending along the longitudinal axis and connecting the first and second end regions.

12. The handle assembly of claim 11 wherein the longitudinal axis is oriented vertically; and wherein the first and second mounts connect to the wall along an axis parallel to the longitudinal axis.

13. The handle assembly of claim 1 further comprising a biasing member positioned between the second end region of the handle and the second mount, the biasing member biasing the handle towards the first position.

14. The handle assembly of claim 1 wherein the handle is without a biasing member to move the handle towards one of the first and second positions.

15. A handle assembly comprising:

first and second mounts, each mount to connect to a wall, the first mount defining a first recessed region, and the second mount defining a second recessed region;

a first handle extending along a longitudinal axis between first and second end regions, the first and second end regions received for translation along the longitudinal axis within the first and second recessed regions of the first and second mounts, respectively;

a second handle having third and fourth end regions each connected and fixed relative to the first handle, the third and fourth end regions spaced apart from one another such that an outer surface of the first handle therebetween is accessible for grasping by a user;

a first locking element received within the first recessed region and connected to the first mount; and a second locking element connected to a first end region of the first handle, the second locking element engaging with the first locking element to retain the first handle in one of a plurality of pivotal positions relative to the first and second mounts, the first and second locking elements cooperating to constrain rotation of the first handle relative to the first and second mounts, wherein translation of the first handle from a first longitudinal position to a second longitudinal position disengages the first and second locking elements, and wherein the first handle is rotatable relative to the first and second mounts when the first and second locking elements are disengaged;

wherein the first end region of the first handle remains within the first recessed region and the second end region of the first handle remains within the second recessed region with the first handle in the first longitudinal position and the second longitudinal position.

16. The handle assembly of claim 15 wherein a face of the first locking element defines a series of first teeth extending radially; and wherein a face of the second locking element defines a series of second teeth extending radially, wherein one of the second teeth is sized to be received between adjacent first teeth.

17. The handle assembly of claim 15 comprising a first bushing positioned between the first mount and the first end region of the first handle; and a second bushing positioned between the second mount and the second end region of the first handle.

18. The handle assembly of claim 15 wherein a lower face of the first locking element defines one of a key and a keyway;

wherein the first mount defines the other of a key and a keyway; and wherein the key is received by the keyway when the first locking element is positioned within the first mount to prevent rotation of the first locking element relative to the first mount.

19. A method of installing a grab bar assembly comprising:

mounting a first mount to a wall surface;

mounting a second mount to the wall surface, the first and second mounts aligned along a longitudinal axis;

positioning first and second end regions of a grab bar within first and second recessed regions defined by the first and second mounts, respectively;

engaging a first locking element connected to the first mount with a second locking element connected to a first end region of the grab bar, the first locking element positioned within the first recessed region of the first mount; and adjusting a position of the grab bar relative to the first and second mounts by translating the grab bar along the longitudinal axis and towards the second mount from a first longitudinal position to a second longitudinal position thereby disengaging the second locking element from the first locking element, pivoting the grab bar about the longitudinal axis, and translating the grab bar from the second longitudinal position to the first longitudinal position along the longitudinal axis and towards the first mount thereby engaging the second locking element with the first locking element;

wherein the first end region of the grab bar remains within the first recessed region and the second end region of the grab bar remains within the second recessed region with the grab bar in the first longitudinal position and the second longitudinal position.

20. The method of claim 19 further comprising positioning a key defined by one of a lower face of the first locking element and the first mount into a keyway defined by the other of the lower face of the first locking element and the first mount, wherein the key is received by the keyway when the first locking element is positioned within the first mount to prevent rotation of the first locking element relative to the first mount.

* * * * *